US006967272B2

(12) United States Patent
Green

(10) Patent No.: US 6,967,272 B2
(45) **Date of Patent: *Nov. 22, 2005**

(54) SUPPORT BASE FOR INSTRUMENT COMPONENTS

(75) Inventor: W. Adrian Green, Capitol Heights, MD (US)

(73) Assignee: W. Adrian Greene, Capitol Heights, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/914,445

(22) Filed: Aug. 9, 2004

(65) Prior Publication Data

US 2005/0011340 A1 Jan. 20, 2005

Related U.S. Application Data

(63) Continuation of application No. 10/253,454, filed on Sep. 24, 2002, now Pat. No. 6,794,565, which is a continuation-in-part of application No. 29/149,059, filed on Oct. 2, 2001, now Pat. No. Des. 466,146, which is a continuation-in-part of application No. 29/149,087, filed on Oct. 2, 2001, now Pat. No. Des. 465,511.

(51) Int. Cl.[7] ..... G10D 13/02

(52) U.S. Cl. ..... 84/421; 84/327; 84/453; 84/422.1

(58) Field of Search ..... 84/421, 327, 453, 84/422.1

(56) References Cited

U.S. PATENT DOCUMENTS

| | | | |
|---|---|---|---|
| 4,187,947 | A | 2/1980 | Dunn et al. |
| 4,240,646 | A | 12/1980 | Scott |
| 4,304,166 | A | 12/1981 | Stefano et al. |
| 4,445,415 | A | 5/1984 | Izquierdo |
| 4,632,002 | A | 12/1986 | Clevinger |
| 4,691,611 | A | 9/1987 | May |
| 6,215,055 | B1 | 4/2001 | Saravis |
| 6,794,565 | B2 | 9/2004 | Green |

*Primary Examiner*—Shih-Yung Hsieh
(74) *Attorney, Agent, or Firm*—Fay Sharpe Fagan Minnich & McKee; Brian E. Turung; Robert V. Vickers

(57) ABSTRACT

A support base for instrument components, including instrument components having a pedal associated therewith, that includes a base member and one or more component retainers. Various types of component retainers can be used either individually or in combination with one another. Such component retainers include hook-and-loop fasteners extending between the base member and an associated instrument component. The base member can include one or more passages, such as holes or slots, through which a component retainer, such as a fastener, can extend to engage an associated instrument component. Also, a component retainer, such as a post, may extend from either the base member or the instrument component to engage the other of same. The post may be integral or detachably supported on either the base member or instrument component.

28 Claims, 19 Drawing Sheets

SUPPORT BASE FOR INSTRUMENT COMPONENTS

This patent application is a continuation of U.S. patent application Ser. No. 10/253,454 filed Sep. 24, 2002 now U.S. Pat. No. 6,794,565, which in turn is a continuation-in-part of U.S. Design application No. 29/149,059, filed on Oct. 2, 2001, now U.S. Pat. No. D466,146. This patent application is also a continuation of U.S. patent application Ser. No. 10/253,454 filed Sep. 24, 2002, now U.S. Pat. No. 6,794,565 which in turn is a continuation-in-part of U.S. Design application No. 29/149,087, filed on Oct. 2, 2001, now U.S. Pat. No. D465,511.

INCORPORATION BY REFERENCE

The entire disclosure of U.S. Design application Nos. 29/149,059 and 29/149,087, each filed on Oct. 2, 2001 and each entitled ORNAMENTAL DESIGN FOR A DRUM STAND, are hereby incorporated herein by reference.

BACKGROUND OF THE INVENTION

This invention relates to the art of musical instruments and, more particularly, to a supporting structure for use with components or pieces of musical or percussion instruments.

In many situations, musical and percussion instruments are made up of various components or pieces that are positioned adjacent one another on a floor or performance platform. For example, a drum set can include a bass drum, a snare drum, one or more tom-tom drums and one or more cymbals. Typically, one or more of these components or pieces will include a pedal associated with the piece, and many times two or more pedals are employed to play a complete instrument. For example, in a typical drum set, the bass drum includes an associated pedal and at least one cymbal set also includes an associated pedal.

In these situations where various components or pieces are positioned adjacent one another, it is desirable to have each of these pieces properly spaced apart and oriented relative to one another so that the musician will be able to comfortably reach each one. However, in many situations, instruments, such as drum sets, for example, are routinely moved from one venue to another. Typically, this results in the instrument being transported to a venue, assembled, played for a short period of time, and then disassembled for transport to another venue. As a result, differences in the position of the instrument pieces result each time the instrument is set up. This is so, even though best efforts may have been made in trying to maintain consistent positioning. As such, it is desirable to develop a support base to aid in setting up the instrument components or pieces in the same relative position each time.

Additionally, in the foregoing circumstances, considerable time and effort is commonly spent assembling the instrument and positioning each of the various components properly, so that each of the components will be comfortably positioned for the musician. This often includes multiple adjustments and repositioning efforts that add to the already considerable time for setting up the instrument. Accordingly, it is also beneficial to develop a support base that will minimize the amount of time required to set up and adjust the relative position of each component of the instrument.

Furthermore, even though the various components and pieces of the instrument have been properly positioned prior to a performance, the components often move relative to one another due to the physical exertion of the musician during the performance. This, of course, is undesirable and can cause the musician to become distracted or uncomfortable during the performance. Therefore, it is desirable to develop a support base that will maintain various instrument components and pieces in relative position to one another during a performance.

SUMMARY OF THE INVENTION

One aspect of the present invention is the provision of a unique support base for supporting one or more components of a musical or percussion instrument. In one embodiment of the present invention, the support base includes a base member and one or more component retainers for retaining each of the one or more components in a selected position.

Another and/or alternative aspect of the present invention is the provision of a support base for musical or percussion instrument components at least a portion of which are securely mounted on a base member, each in a selected position, to minimize the time commonly associated with setting up the instrument. In another and/or alternative embodiment, a support base includes a base member having one or more passages therethrough and one or more fasteners each adapted to suitably engage the base member and an associated one of the portion of instrument components to be secured to the base member.

Yet another and/or alternative aspect of the present invention is the provision of a support base for musical or percussion instrument components at least a portion of which are removeably supported on a base member, each in a selected position, to provide support in at least one direction for such components while allowing the same to be easily and simply removed or re-positioned. In yet another and/or alternative embodiment, a support base includes a base member and one or more hook-and-loop fasteners extending between the base member and an associated one of the portion of instrument components to be supported on the base member. In a further and/or alternative embodiment, a support base includes a base member and one or more posts extending from the base member to provide support in at least one direction for an associated one of the portion of instrument components supported on the base member. In still another and/or alternative embodiment, a support base includes a base member having one or more passages, such as holes or elongated slots, extending into the base member. One or more associated instrument components include at least one post extending therefrom and suitable for engaging a passage of the base member.

One advantage of a support base in accordance with the present invention is that instrument components can be repeatably positioned relative to one another as the instrument is repeatedly assembled and disassembled.

Another advantage of a support base in accordance with the present invention is that instrument components can be securely mounted on the support platform, minimizing time associated with setting up and taking apart the instrument.

Still another advantage of a support base in accordance with the present invention is that instrument components can be removeably supported on the support base allowing for support of the components in one or more directions while permitting quick and simple adjustment of the position of the components.

These and other aspects and advantages of the invention will become apparent to those of skill in the art upon reading and understanding the following detailed description of preferred embodiments of the invention taken together with the drawings.

BRIEF DESCRIPTION OF THE DRAWINGS

This invention may take physical form in certain parts and arrangements of parts, preferred embodiments of which will be described in detail and illustrated in the accompanying drawings that form a part hereof and wherein.

DETAILED DESCRIPTION OF THE PREFERRED EMBODIMENT

Figure 1:
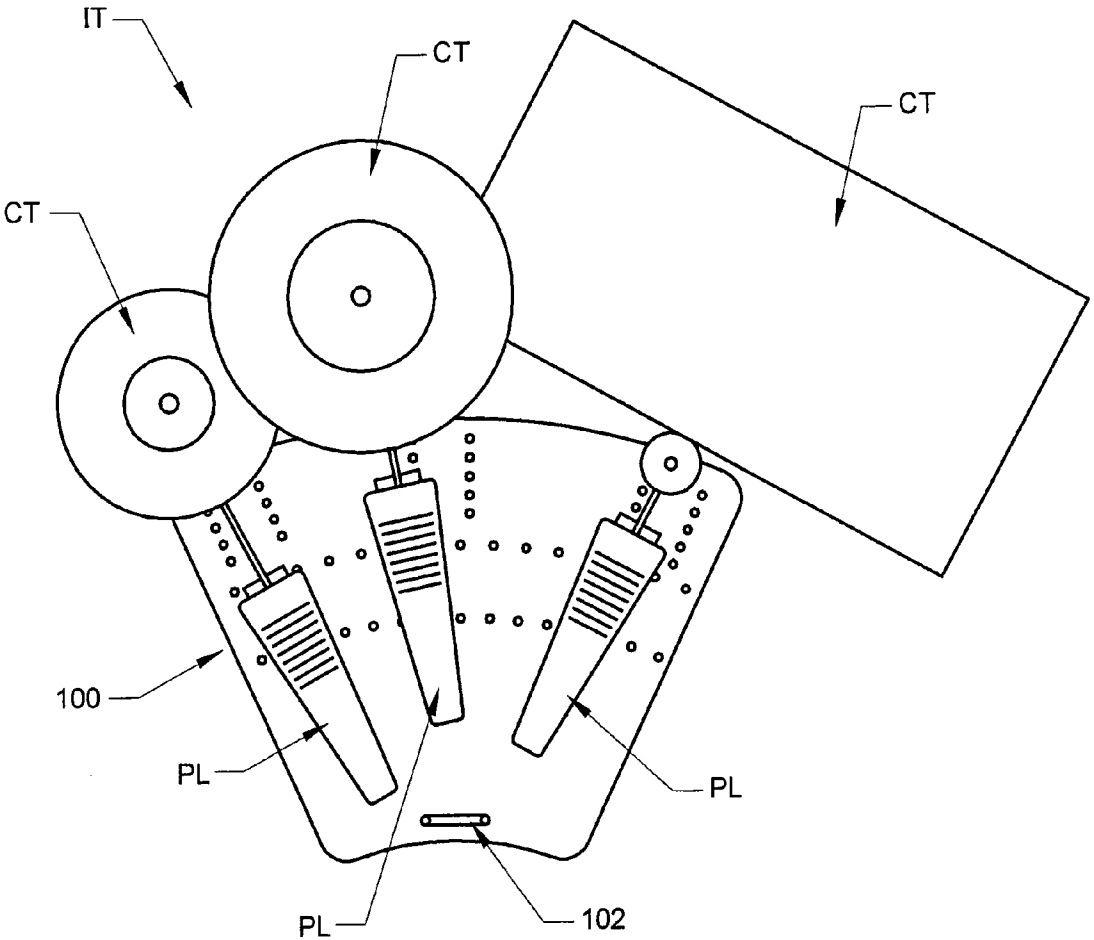
FIG. 1 is an illustration of a plan view of various instrument components shown in use with one embodiment of a support base in accordance with the present invention.

Referring now in greater detail to the drawings, wherein the showings are for the purposes of illustrating preferred embodiments of the invention only, and not for the purpose of limiting the invention, FIG. 1 illustrates a support base 100 and an instrument IT with numerous instrument components CT such as, but not limited to, a bass drum, one or more cymbals, a snare drum, and/or the like, for example. One or more of the instrument components can include a pedal assembly PL that is associated with the component, and at least a portion of each pedal assembly PL is positioned on support base 100. A handle 102 is provided on the support base and may take any suitable form. For example, handle 102 could be a rigid handle, a flexible handle or even a passage, such as a hole or slot, provided through the support base that is suitable for functioning as a handle. As can be appreciated, the support base can include more than one handle, or can have no handle.

Figure 2:
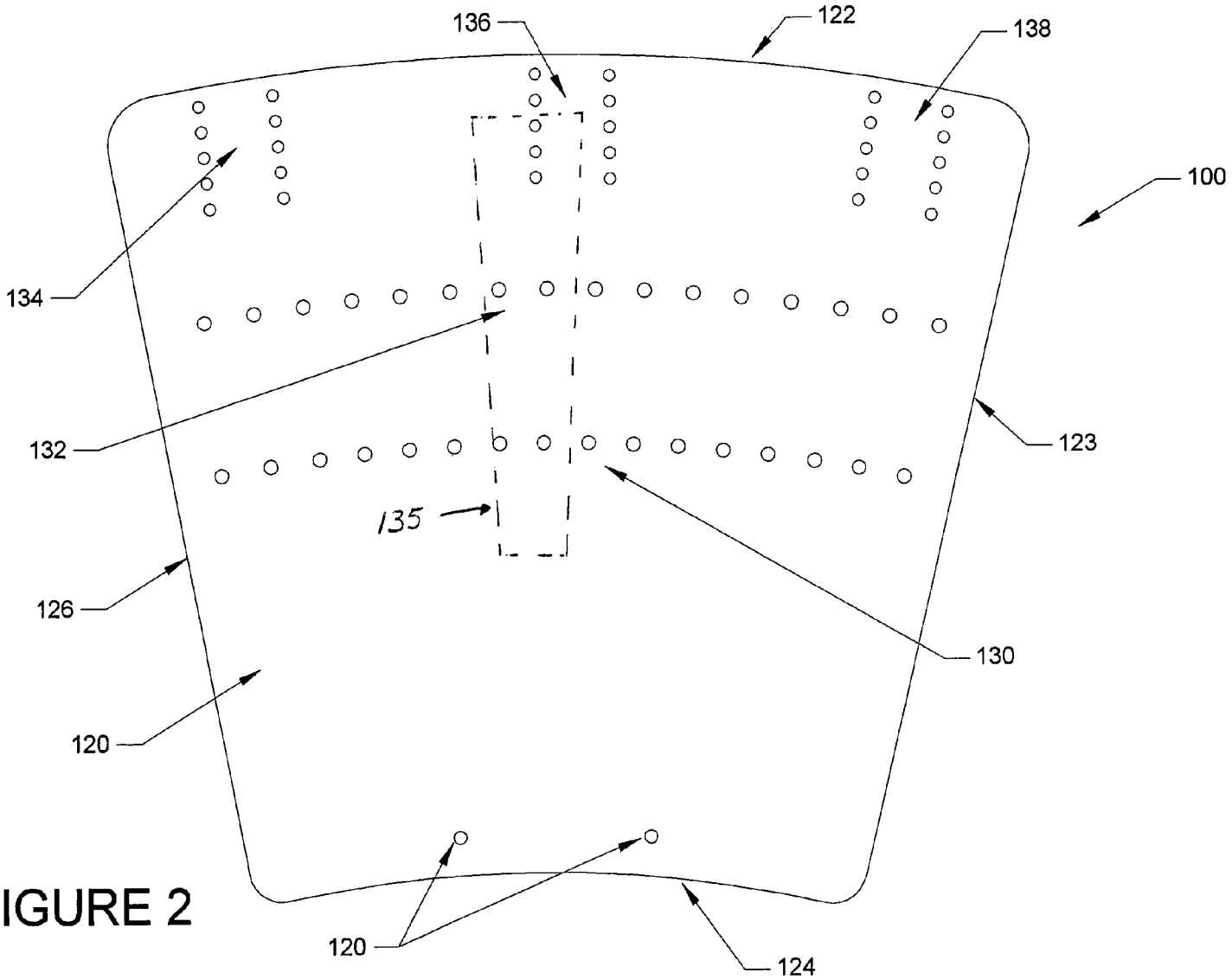
FIG. 2 is a plan view of the support base illustrated in FIG. 1.

As shown in FIG. 2, support platform 100 includes a base member 120 that has a front edge 122, a rear edge 124 and two generally opposing side edges 126, 128. Both front edge 122 and rear edge 124 are shown as being generally curvilinear, and side edges 126 and 128 are disposed at an angle to one another such that base member 120 is somewhat "pie shaped." It will be appreciated, however, that the base member may take any suitable shape or form, including rectangular, circular, ovoid or any other regular or irregular shape. Additionally, the base member may be formed from any suitable material, including metal, wood, plastic or composite materials, for example. The base member can also have one or more of a wide range of thicknesses to affect the desired flexibility and durability of the base member.

The base member shown in FIG. 2 also includes numerous passages, such as holes or slots. A first series of passages 130, shown as generally circular holes in FIG. 2, are disposed along the base member extending between the two side edges along a curvilinear path. A second series of passages 132, also shown as generally circular holes, extend along a curvilinear path similar to that of the first series of passages but spaced apart therefrom toward front edge 122. Three additional groups of passages 134, 136 and 138 are disposed each in two adjacent columns that extend generally between the front and rear edges and positioned toward the former thereof. A pair of spaced apart holes 140 is provided in base member 120 for supporting a handle, such as handle 102 shown in FIG. 1. It will be appreciated, however, that any of the series of passages 130 and 132 and the groups of passages 134, 136 and 138 may take any other suitable grouping or configuration without departing from the principles of the present invention. Additionally, it will also be appreciated that either a greater or lesser number of passages may be provided in any suitable pattern or configuration. Also, combinations of holes and slots or any other suitably shaped of passages may also be used without departing from the principles of the present invention. Furthermore, it should be appreciated that in addition to the passages provided in a base member in accordance with the present invention, the musician may make other passages in the base member to better position the component, such as a pedal assembly, on the base member. As shown in FIG. 2. the base member 120 includes an indicator 135, such as a visual or a tactile indicator, to correspond to certain components and component placements on the base member.

Figure 3:
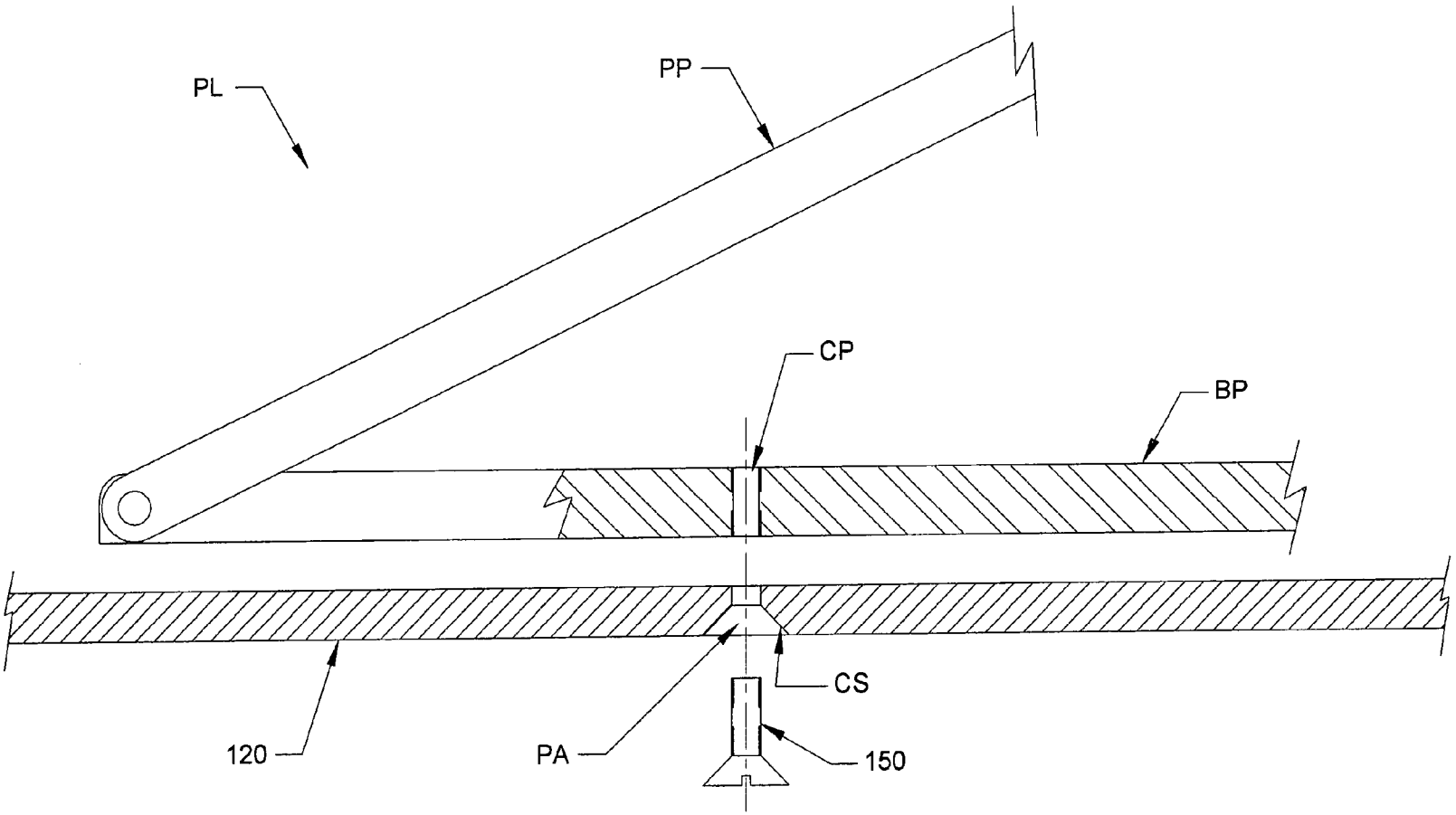
FIG. 3 is an illustration of an exploded, partial cross-sectional side elevation view of a support base and fastener in accordance with the present invention shown with an associated pedal from an instrument component.
Figure 4:
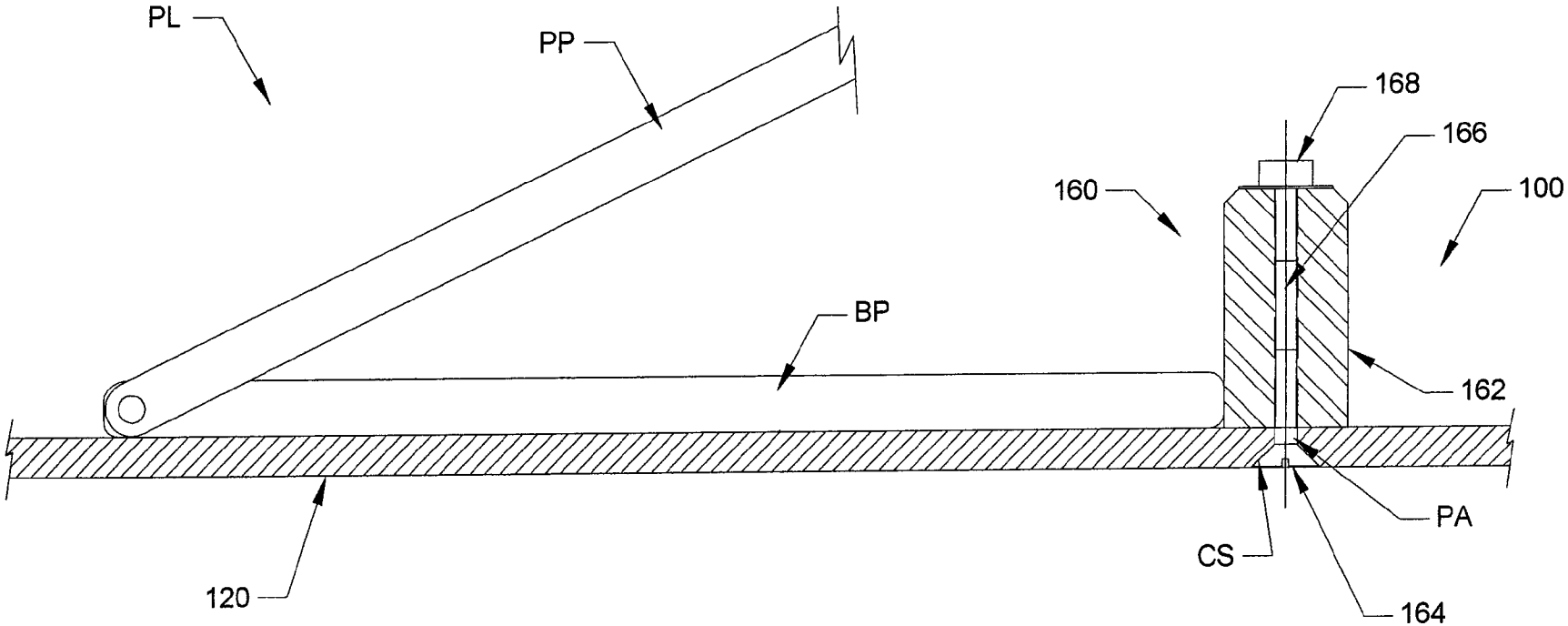
FIG. 4 is an illustration of a partial, cross-sectional side elevation view of a support base and post in accordance with the present invention shown with an associated pedal from an instrument component.
Figure 5:
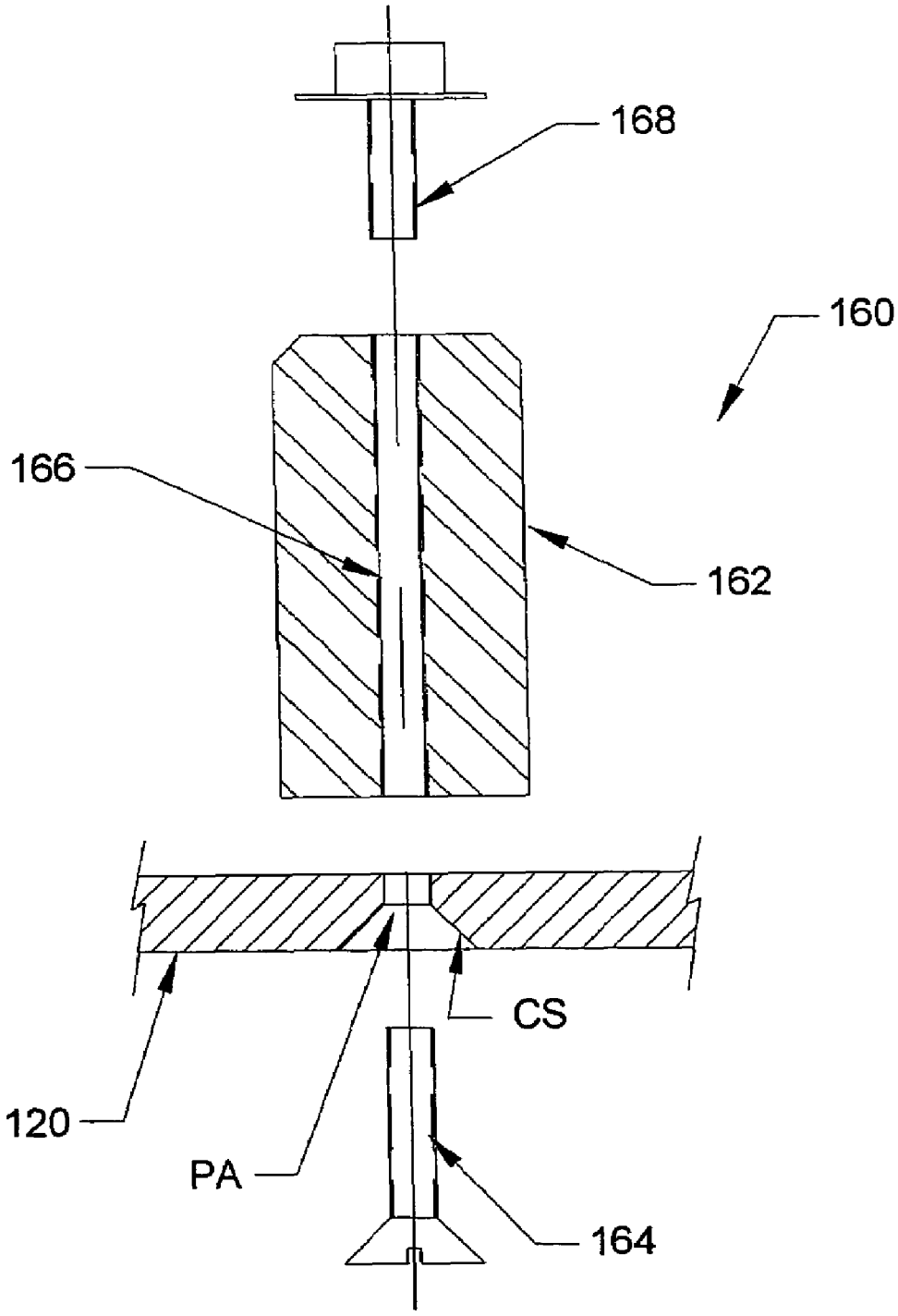
FIG. 5 illustrates an exploded, partial cross-sectional side elevation view of the support base and post shown in FIG. 4.

While pedal assembly PL is illustrated in FIGS. 3–7, it should be appreciated that other instrument components may be used or retained in accordance with the present invention. The subject invention is not intended to be limited to retaining pedal assemblies, which are shown in the drawings as merely an example of an instrument component in use with the present invention. As such, FIG. 3 shows support base 100 and an associated pedal assembly PL that includes a bottom portion BP and a pedal portion PP. The support base also includes a retainer, shown as a fastener 150 in FIG. 3. Fastener 150 is illustrated as a typical flat head, threaded fastener. However, it will be appreciated that other suitable fasteners may be used such as, but not limited to, rivets, for example. Fastener 150 will extend through a passage PA provided in base member 120 and engage a complimentary passage CP in the bottom portion of the pedal assembly. The pedal assembly can thereby be retained on base member 120 by tightening fastener 150 into complimentary passage CP. In FIG. 3, complimentary passage CP is shown as a threaded hole. However, it will be appreciated that any suitable passage can be used in association with the selected fastener. Furthermore, it should be appreciated that passage PA may be any suitable passage provided on base member 120, including any one of the passages of series 130 or 132, of groups 134, 136 or 138, or any passage made by the musician. What's more, passage PA is shown in FIGS. 3–5 as including a countersink CS. However, any suitable relief or geometry may be provided at passage PA, such as a counterbore or chamfer, for example.

FIG. 4 illustrates support base 100 in association with pedal assembly PL and having a retainer, shown as a post assembly 160, for retaining the pedal assembly on the support base. FIGS. 4 and 5 show base member 120 having a passage PA, as discussed with regard to FIG. 3, with a countersink CS. A post 162 is supported on base member 120 by a fastener 164. The fastener extends through passage PA and engages a complimentary passage 166 extending through post 162. A cap 168 extends into and covers the other end of passage 166. Cap 168 can threadably engage passage 166, and can include a slot or hex (not shown) along a portion thereof for use as wrench flats for tightening post 162 and fastener 164 together. Other arrangements are also contemplated for securing the post on the base member. For example, a clearance hole may be provided through the post, and a bolt could extend through both the base member and post and receive a nut to secure the post to the base member.

Figure 6:
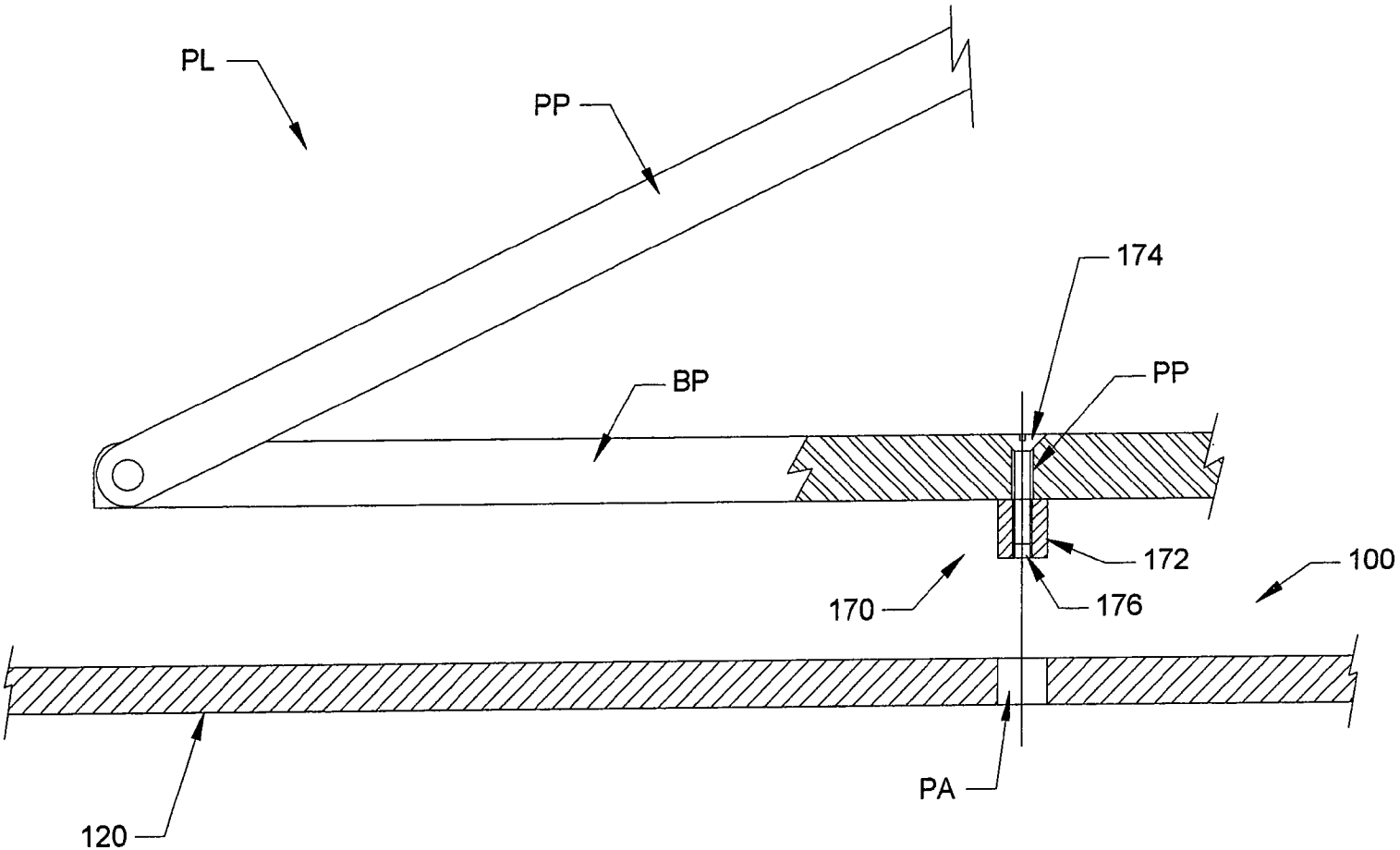
FIG. 6 is an illustration of a partial, cross-sectional side elevation view of a support base and a post in accordance with the present invention shown with an associated pedal from an instrument component.

FIG. 6 shows support base 100 with an associated pedal assembly PL and having a retainer, shown as post assembly 170, for retaining the pedal assembly on the support base. Post assembly 170 includes a post 172 supported on bottom portion BP of the pedal assembly by a fastener 174, which engages a passage 176 extending into post 172. The fastener extends through a complimentary passage CP provided on bottom portion BP of the pedal assembly. Passage CP also includes a countersink CS. Post assembly 170 supported on bottom portion BP of the pedal assembly engages a passage PA provided in base member 120 of the support base 100 to retain the pedal assembly thereon. Fastener 174 is shown in FIG. 6 as being a flat head threaded fastener. However, it will be appreciated that other types of fasteners and fastening arrangements can be used. For example, rivets can be used instead of threaded fasteners. As another example, a nut and bolt arrangement may be used with a clearance passage extending through the post to secure the same to the pedal assembly.

Figure 7:
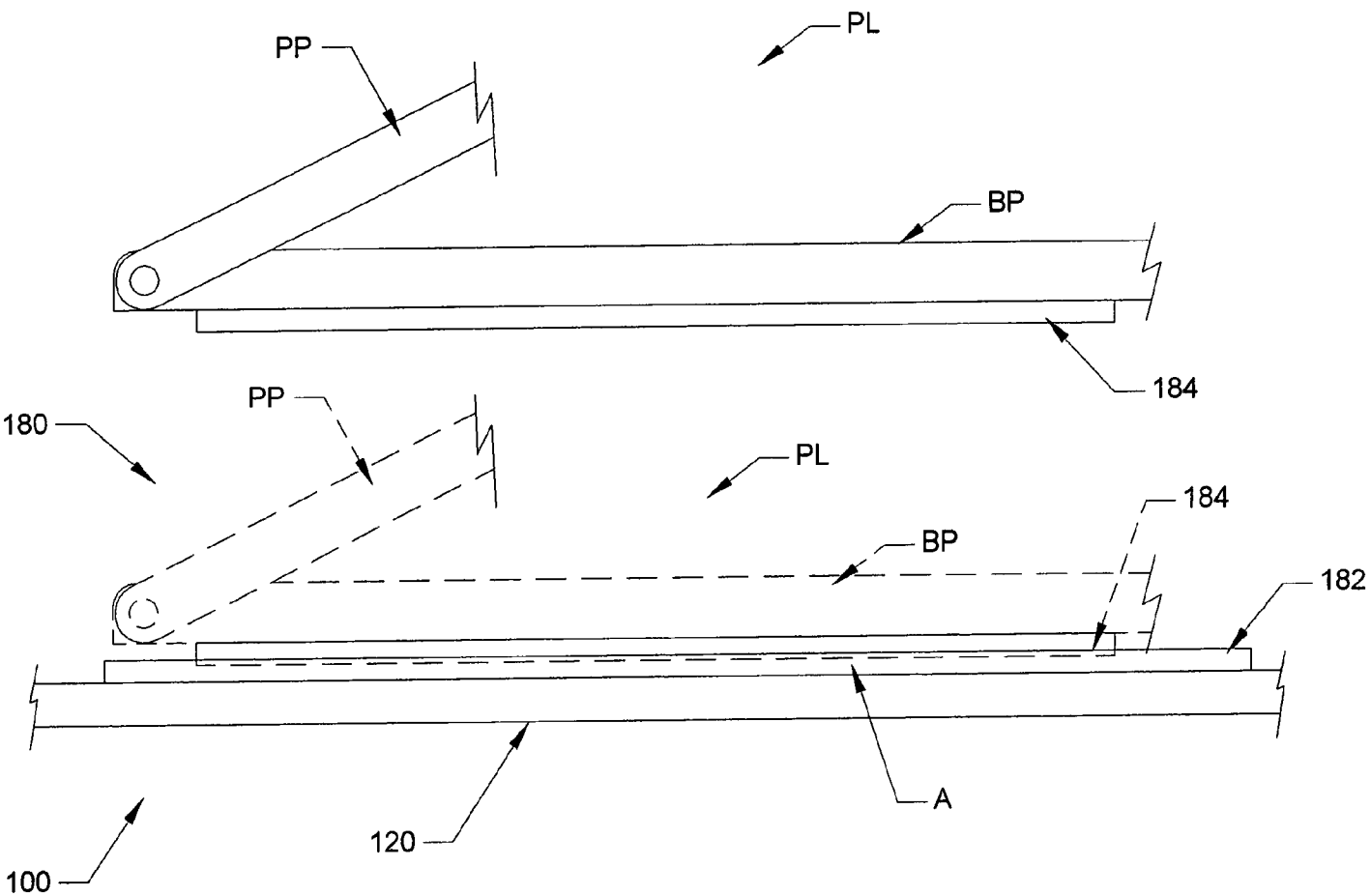
FIG. 7 is an illustration of a partial, cross-sectional side elevation view of a support base and hook-and-loop fastener in accordance with the present invention shown with an associated pedal from an instrument component.

FIG. 7 shows support base 100 with an associated pedal assembly PL and a retainer, shown as a hook and loop fastener 180, for retaining the pedal assembly on the support base. Hook and loop fasteners are well known, and typically include a first portion 182 that is comprised primarily of either a plurality hooks or loops and a second portion 184 that is comprised primarily of the other of a plurality of hooks or loops. In FIG. 7, first portion 182 is secured to base member 120 and second portion 184 is secured to bottom portion BP of the pedal assembly. As shown in dashed lines and indicated by primed (') item numbers, pedal assembly PL' is positioned against base member 120 such that second portion 184' engages first portion 182, as shown by overlap arrow A, and thereby retains the pedal assembly on the support base.

Figure 8:
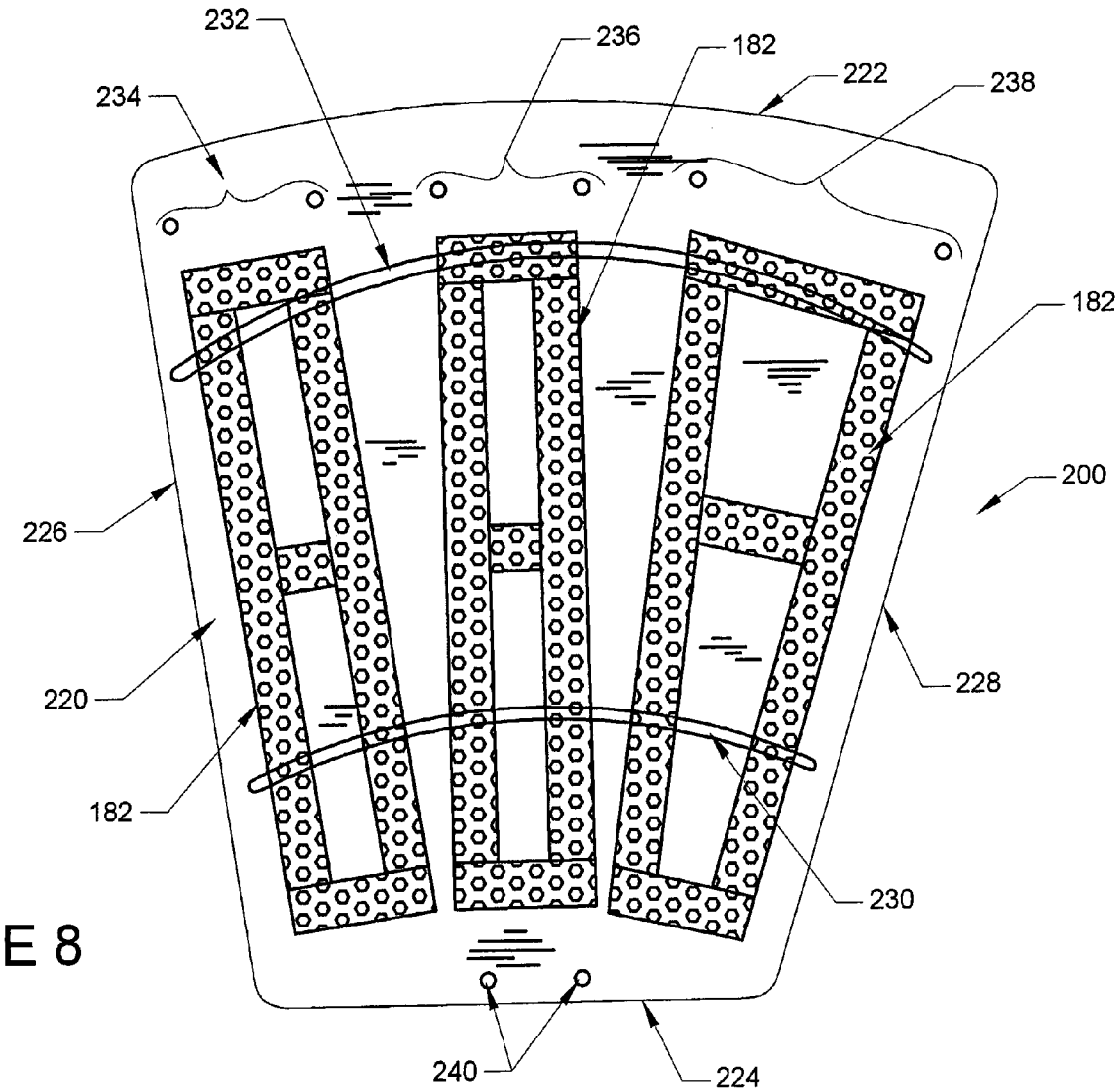
FIG. 8 is an illustration of a plan view of an alternate embodiment of a support base in accordance with the present invention.

FIG. 8 illustrates another and/or alternate embodiment of a support base 200 having a base member 220 and one or more retainers. It will be appreciated that support base 200 and base member 220 can be used with any of the retainers discussed above with regard to FIGS. 3–7, either individually or in combination with one another. Base member 220 includes a generally curvilinear front edge 222, a rear edge 224 and generally opposing side edges 226 and 228. A first slot 230 is disposed along base member 220 extends in a curvilinear path between side edges 226 and 228. Spaced apart from first slot 230 is a second slot 232 that also extends along a curvilinear path between edges 226 and 228. Additionally, three pair of spaced-apart passages 234, 236 and 238 are disposed adjacent front edge 222. As discussed above with regard to FIGS. 3–7, retainers, such as fasteners 150, and post assemblies 160 and 170, may be used with passages 230, 232, 234, 236 and 238 of base member 220. Furthermore, numerous first portions 182 of hook and loop fasteners 180, as shown in FIG. 7, are provided on base member 220. Each of these retainers is capable of retaining an instrument component, such as a pedal assembly, on the base member of the support base. Additionally, one or more passages 240 are provided for supporting or functioning as a handle (not shown), as discussed hereinbefore. As discussed above, the shape of the base member can take any number of different forms. Additionally, the base member can include more or less than two slot arrangements. As can further be appreciated, one or more portions of the bottom of the base member can include hook-and-loop fasteners to facilitate in securing the base member to a floor. The base member can, either alternately or in combination, include standoffs, legs, feet, pads, bumpers or any other suitable floor-engaging members extending from the bottom of the base member.

Figure 9:
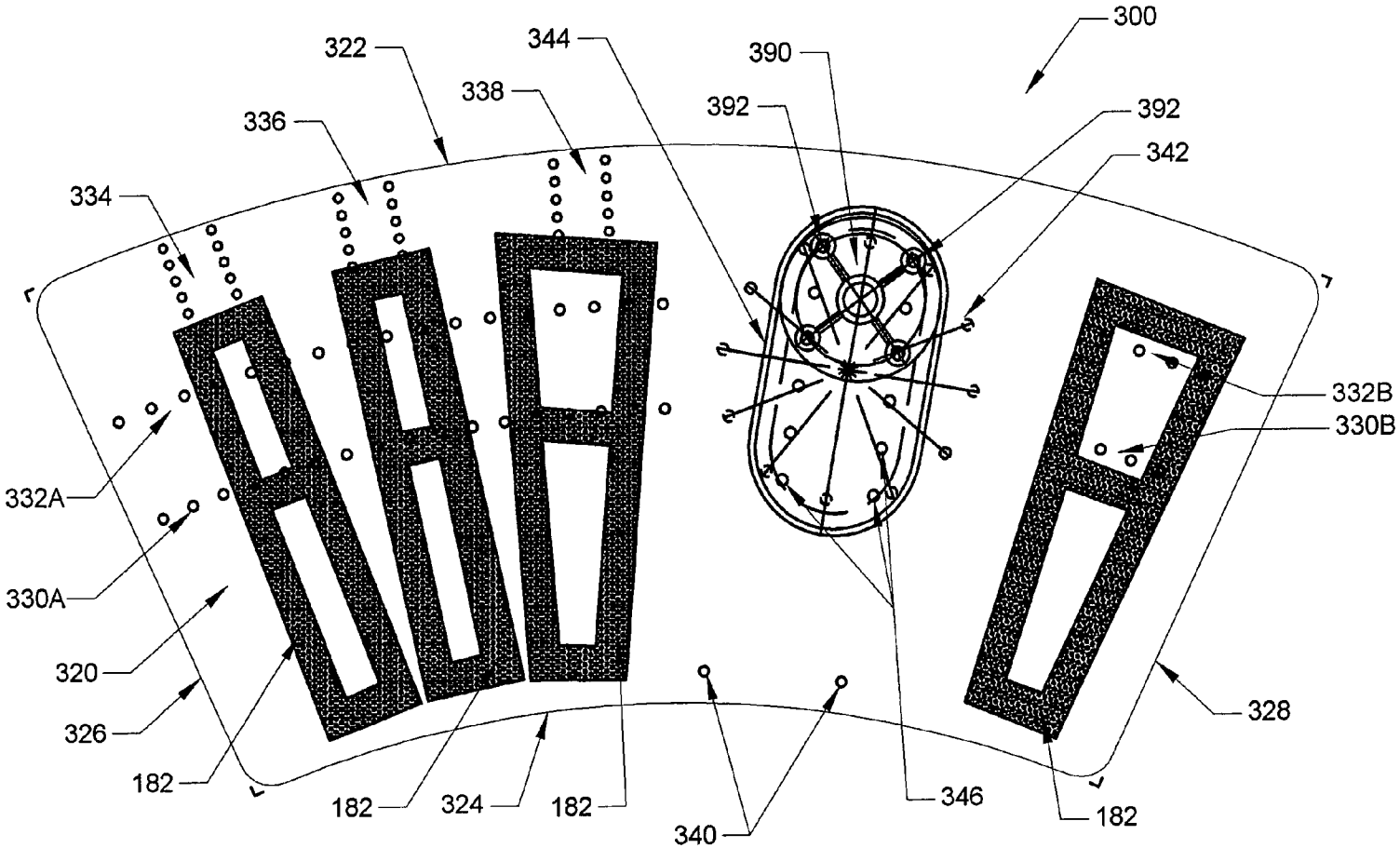
FIG. 9 is an illustration of a plan view of another alternate embodiment of a support base in accordance with the present invention.

FIG. 9 illustrates a support platform 300 having a base member 320 and one or more retainers. It will be appreciated that support base 300 and base member 320 can be used with any of the retainers discussed above with regard to FIGS. 3–7, either individually or in combination with one another. Base member 320 includes a front edge 322, a rear edge 324 and generally opposing side edges 326 and 328. The front and rear edges are shown as being generally curvilinear, with the side edges being disposed at an angle relative to one another such that base member 320 is somewhat "pie shaped." A first series of passages 330 are disposed along the base member in a generally curvilinear path having two portions 330A and 330B. A second series of passages 332 are similarly disposed along the base member but are spaced apart from the first series toward front edge 322. The second series also includes two portions 332A and 332B. Additionally, three groups of passages 334, 336 and 338 are disposed each in two adjacent columns along base member 320 toward front edge 322. As discussed above with regard to FIGS. 3–7, retainers, such as fasteners 150, and post assemblies 160 and 170, may be used with passages 330, 332, 334, 336 and 338 of base member 320. Furthermore, numerous first portions 182 of hook and loop fasteners 180, as shown in FIG. 7, are provided on base member 320. Each of these retainers is capable of retaining an instrument component, such as a pedal assembly, on the base member of the support base. Additionally, one or more passages 340 are provided for supporting or functioning as a handle (not shown), as discussed hereinbefore.

Figure 10:
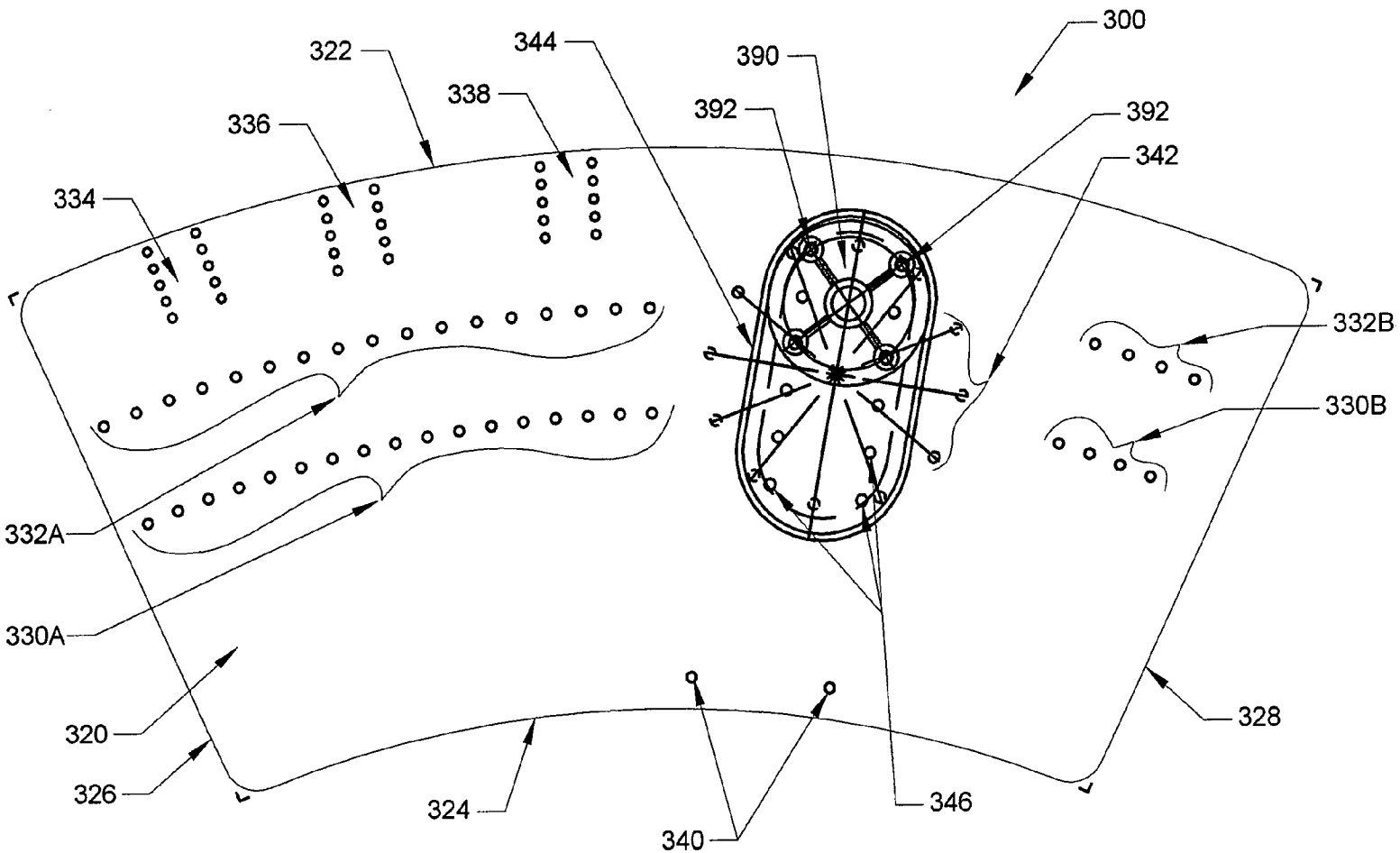
FIG. 10 illustrates a plan view of the support base shown in FIG. 9 without hook-and-loop fasteners.

Portions 330A and 332A respectively of first and second series of passages 330 and 332 are spaced apart from portions 330B and 332B. A plurality of passages 342 are provided on base member 320 between the spaced-apart portions. In FIGS. 9 and 10, passages 342 are shown in a generally circular pattern having one passage provided at approximately the center thereof. A stand mounting member 344 is supported on base member 320 and secured thereto through passages 342 in any suitable manner, such as by using threaded fasteners (not shown). It will be appreciated that stand mounting member 344 includes a plurality of passages (not shown) that match or otherwise correspond to passages 342 of base member 320, such that stand mounting member 344 can be secured in any one of numerous positions and orientations about the pattern of passages 342.

As can be seen in FIGS. 9 and 10, support platform 300, shown in FIG. 10 without first portion 182 of hook-and-loop connector 180, further includes a stand base 390 supported on stand mounting member 344. Numerous passages 392 are provided on stand base 390, and stand mounting member 344 includes numerous corresponding passages 346 suitable for securing stand base 390 thereto, in any one of numerous positions or orientations. As discussed above, the shape of the base member can take any number of different forms. Additionally, the base member can include more or less than two passage arrangements. As can further be appreciated, one or more portions of the bottom of the base member can include hook-and-loop fasteners to facilitate in securing the base member to a floor. The base member can, either alternately or in combination, include standoffs, legs, feet, pads, bumpers or any other suitable floor-engaging members extending from the bottom of the base member.

Figure 11:
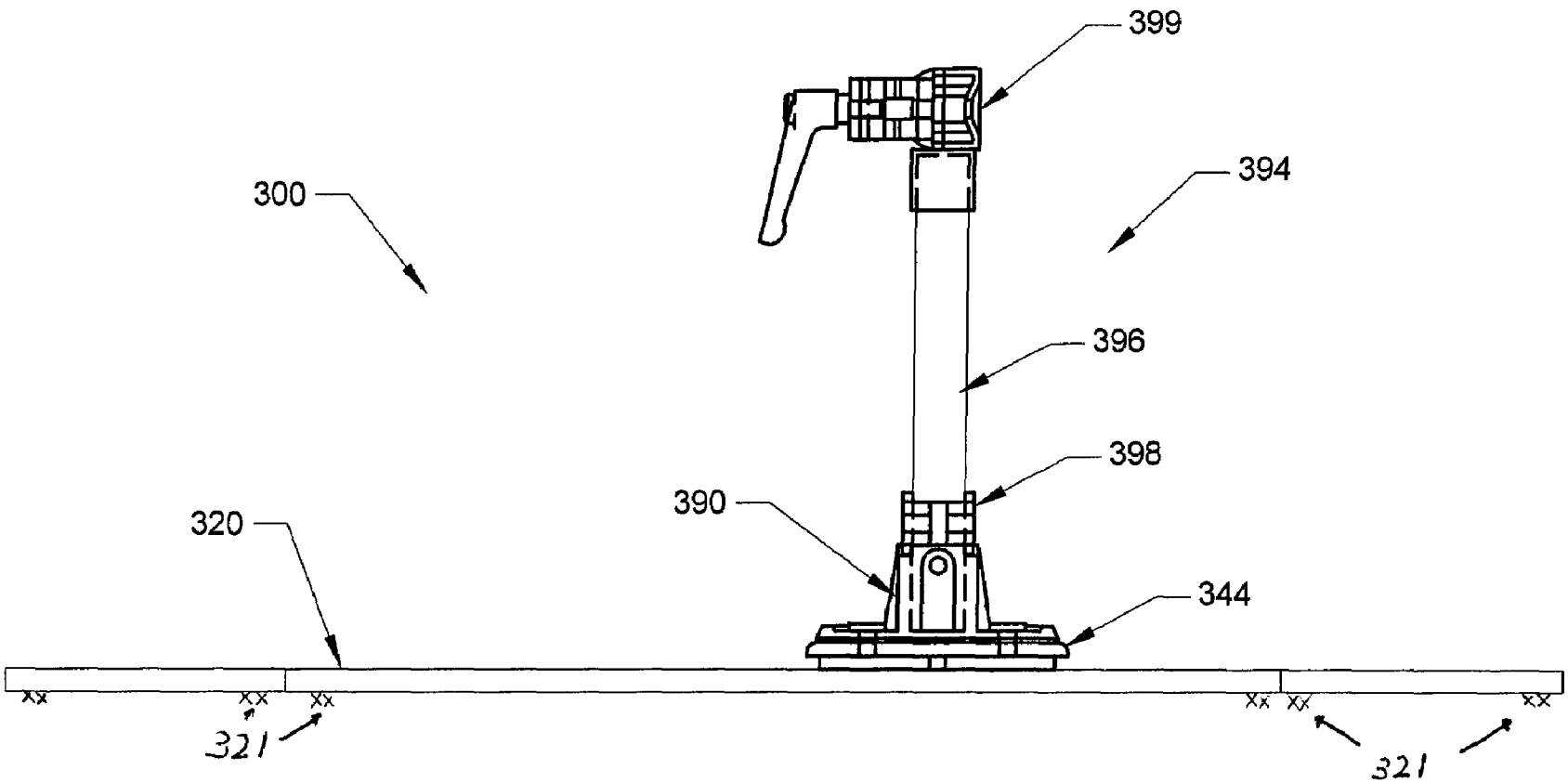
FIG. 11 illustrates a side elevation view of the support base shown in FIG. 10 in use with a instrument stand.
Figure 12:
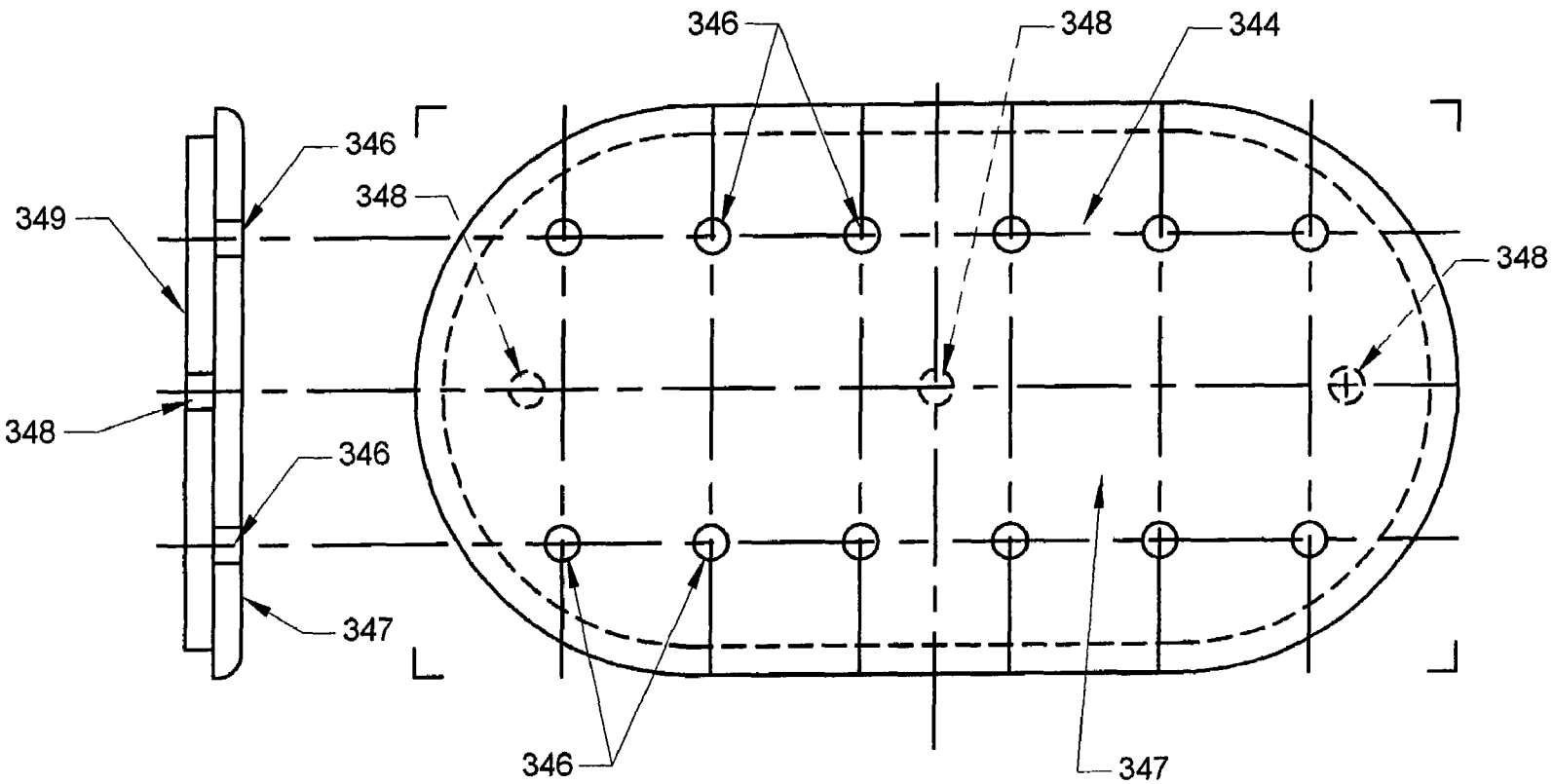
FIG. 12 illustrates a design view of the stand mounting member shown in FIGS. 9–11.

FIG. 11 illustrates support base 300 shown with stand mounting member 344, stand base 390 and an instrument stand 900 is supported on the stand base. Though it should be appreciated that in this and other configurations, the provision of multiple instrument stands is contemplated. The instrument stand includes an elongated tubular member 902, a clamping collar 904 and an instrument mounting collar 914. Stand mounting member 344 is shown in further detail in FIG. 12, and includes passages 346 extending into the stand mounting member from a top surface 347. Additionally, passages 348 extend into the stand mounting passage from bottom surface 349. Passages 348 can be generally aligned with passages 342 in base member 320 such that the stand mounting member can be suitably secured thereon. It will be appreciated that passages 346 and 348, as shown in FIGS. 9–12, can extend either partially or completely through the stand mounting member. As shown in FIG. 11 base member 320 includes floor-engaging members 321 that extend from a bottom of the base member to inhibit movement of the base member on a floor surface.

Figure 13:
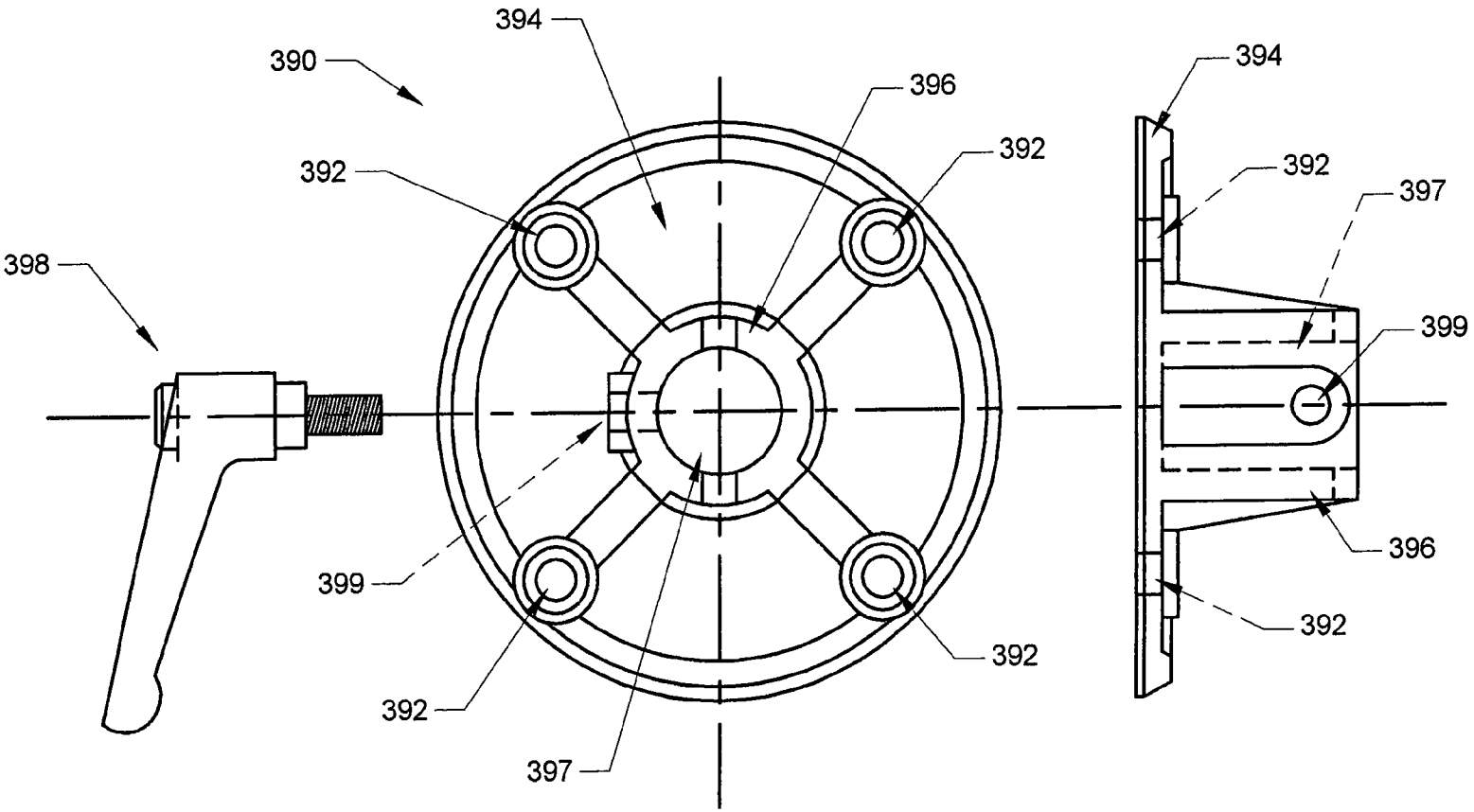
FIG. 13 illustrates a design view of the instrument stand base shown in FIGS. 9–11.

FIG. 13 illustrates stand base 390. The stand base includes a bottom flange 394 and a support column 396 extending from the bottom flange. A bore 397 extends into column 396 and is suitable for supporting tubular member 902 of instrument stand 900. A threaded handle 398 engages a complimentary hole 399 extending generally transversely relative to bore 397, and is suitable for projecting into the bore through the hole to engage and thereby secure the tubular member received therein. Passages 392 extend through flange 394 and have a pattern complimentary to passages 346 in stand mounting member 344 so that the stand base can be secured thereto using suitable fasteners (not shown).

Figure 14:
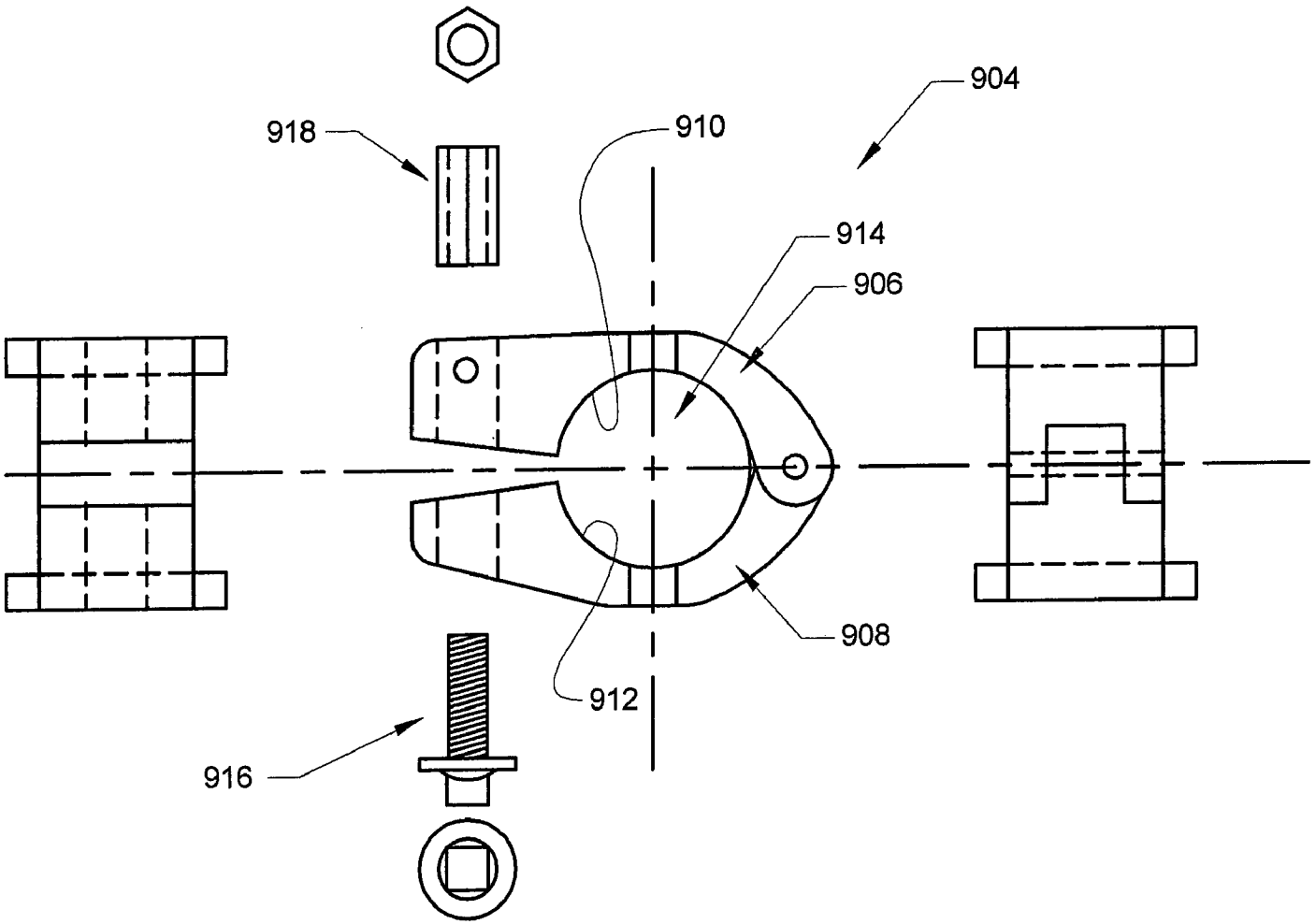
FIG. 14 illustrates a design view of the clamping collar shown in FIG. 11.

FIG. 14 shows clamping collar 904 having to hingedly connected collar halves 906 and 908. Each half respectively includes a curvilinear portion 910 and 912 that forms a clamping opening 914. A fastener 916 and a nut 918 engage one another through each of the collar halves to provide clamping adjustment to the collar.

Figure 15:
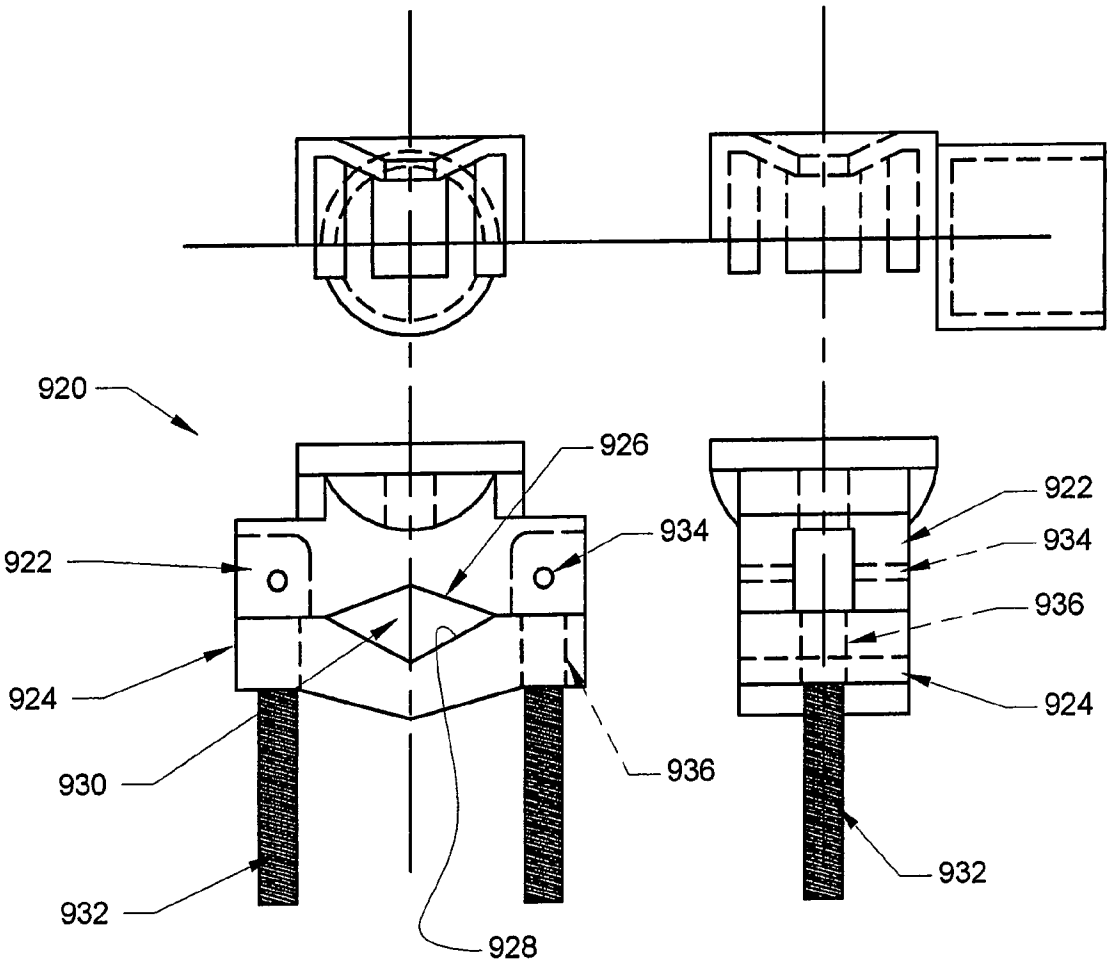
FIG. 15 illustrates a design view of the instrument mounting collar shown in FIG. 11.

FIG. 15 shows instrument mounting collar 920 having two collar halves 922 and 924. Each half respectively includes a notch 926 and 928 forming a clamping opening 930. Two threaded members 932 are hingedly supported on collar half 922 by pins 934. The threaded members extend through passages 936 in collar half 924, which is retained thereon by suitable thread engaging members (not shown), such as nuts, for example.

Figure 16:
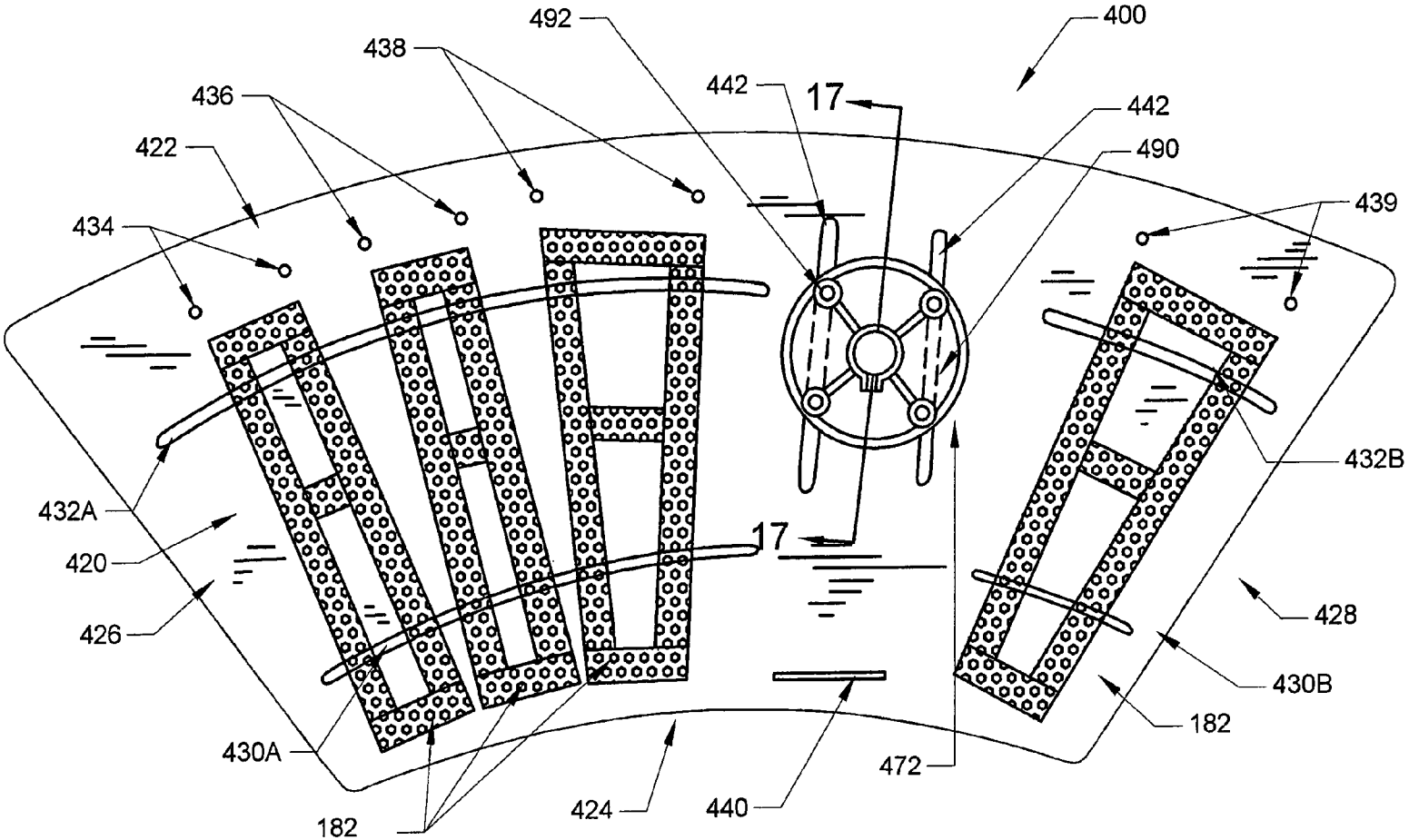
FIG. 16 is an illustration of a plan view of yet another alternate embodiment of a support base and stand mounting member in accordance with the present invention.

FIG. 16 illustrates another and/or alternate embodiment of a support base 400 having a base member 420 and one or more retainers. An elongated slot 406 is provided for securing a handle (not shown) to the base member or, in the alternative, itself acting as a handle for the support base. It will be appreciated that support base 400 and base member 420 can be used with any of the retainers discussed above with regard to FIGS. 3–7, either individually or in combination with one another. Base member 420 includes a front edge 422, a rear edge 424 and two generally opposing side edges 426 and 428. Front edge 422 and rear edge 424 are generally curvilinear, and side edges 426 and 428 are disposed at an angle to one another such that base member 420 is somewhat "pie shaped." A first series of passages 430 includes slot portions 430A and 430B disposed in a curvilinear path along member 420 extending between edges 426 and 428. A second series of passages 432 includes first and second portions 432A and 432B disposed also in a curvilinear path along base member 420 but spaced apart from first series 430. Portions 430A and 432A are spaced apart from portions 430B and 432B. Four pair of spaced-apart passages 434, 436, 438 and 439 are disposed along base member 420 adjacent front edge 422. As discussed above with regard to FIGS. 3–7, retainers, such as fasteners 150, and post assemblies 160 and 170, may be used with passages 430, 432, 434, 436, 438 and 439 of base member 420. Furthermore, numerous first portions 182 of hook and loop fasteners 180, as shown in FIG. 7, are provided on base member 420. Each of these retainers is capable of retaining an instrument component, such as a pedal assembly, on the base member of the support base. Additionally, a pair of spaced-apart, elongated passages 442 extend along base member 420. As discussed above, the shape of the base member can take any number of different forms. Additionally, the base member can include more or less than two slot arrangements. As can further be appreciated, one or more portions of the bottom of the base member can include hook-and-loop fasteners to facilitate in securing the base member to a floor. The base member can, either alternately or in combination, include standoffs, legs, feet, pads, bumpers or any other suitable floor-engaging members extending from the bottom of the base member.

Figure 17:
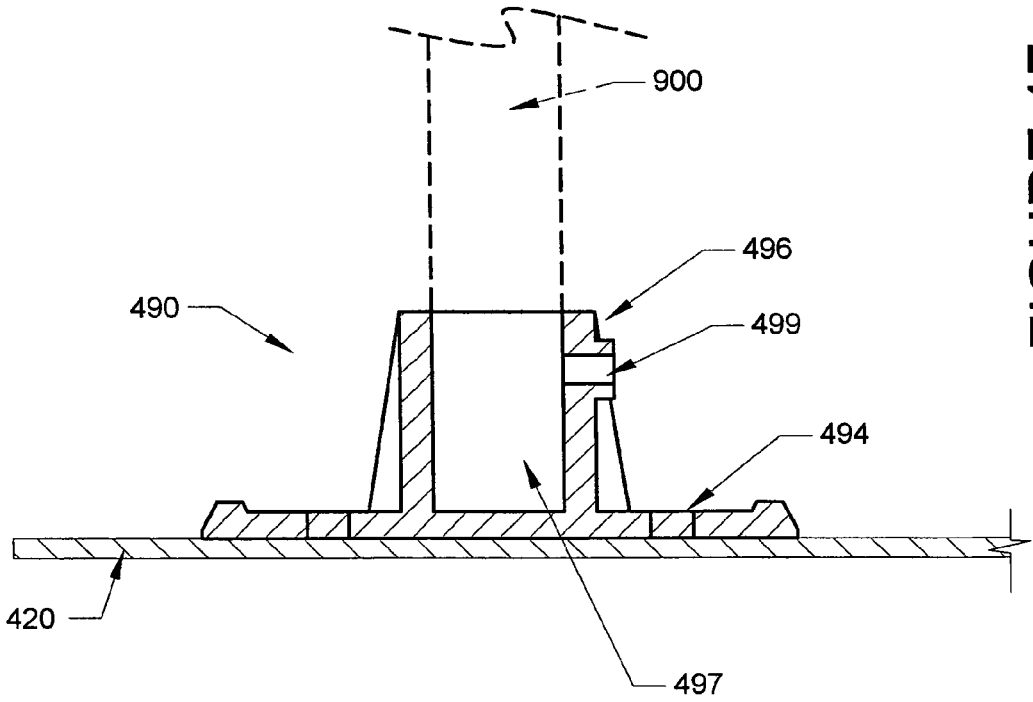
FIG. 17 illustrates a partial cross-sectional side elevation view of the support base and stand mounting member taken along line 17—17 of FIG. 16.

As illustrated in FIGS. 16 and 17, a stand base 490 is supported on base member 420 adjacent slots 442. It will be appreciated that stand base 490 is substantially identical to stand base 390 discussed above in reference to FIGS. 9–11 and 13, and is suitable for receiving an instrument stand, such as instrument stand 900 also discussed in detail above. Furthermore, it should be appreciated that in this and other configurations, the provision of multiple instrument stands is contemplated. Stand base 490 includes a bottom flange 494 and a support column 496 extending from the bottom flange. A bore 497 extends into column 496 and is suitable for supporting tubular member 902 of instrument stand 900. A threaded handle (not shown) engages a complimentary hole 499 extending generally transversely relative to bore 497, and is suitable for projecting into the bore through the hole to engage and thereby secure the tubular member received therein. Passages 492 extend through flange 494 and have a pattern complimentary to passages 442 in base member 420 so that the stand base can be secured thereto using suitable fasteners (not shown).

Figure 18:
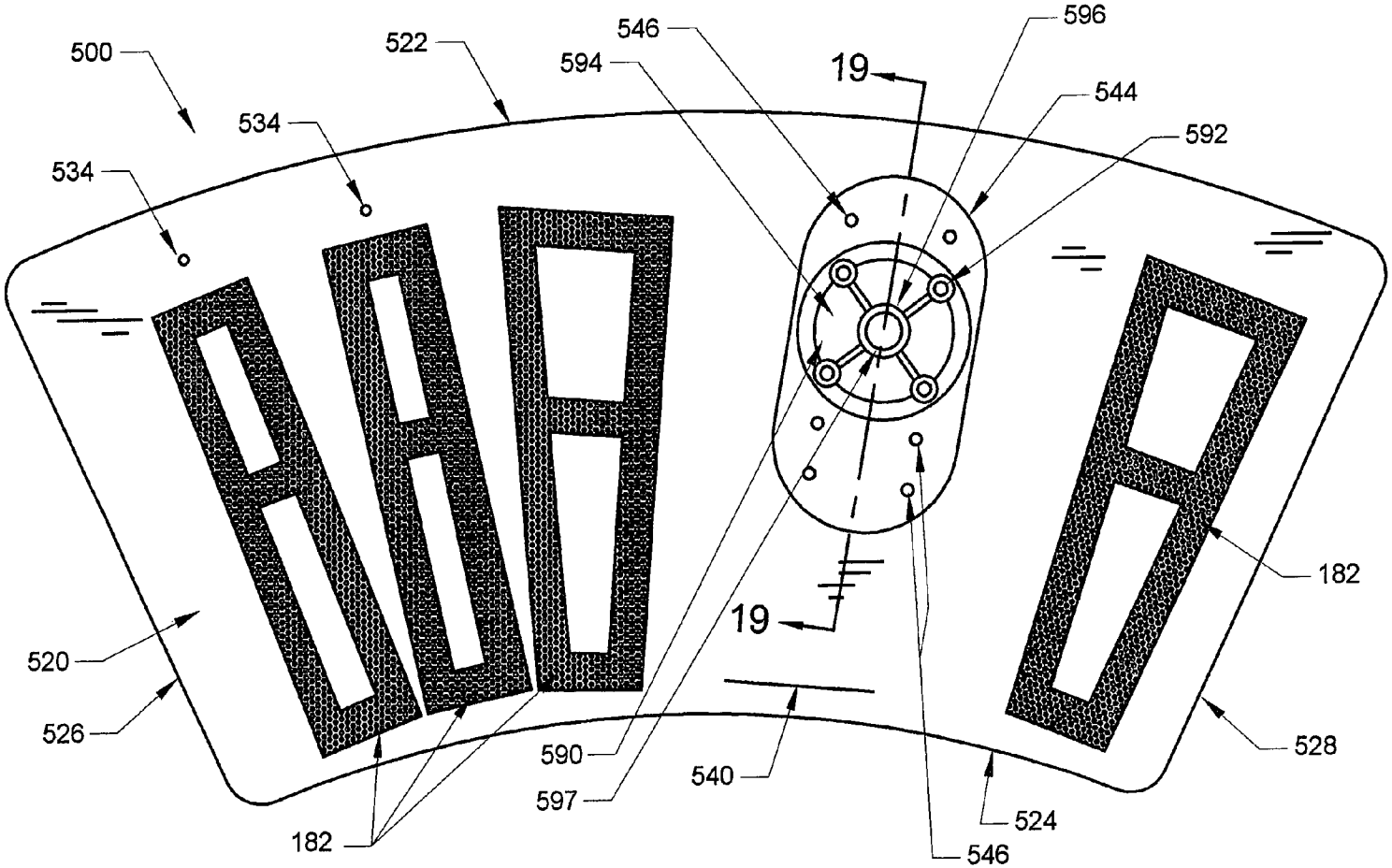
FIG. 18 is an illustration of a plan view of a further alternate embodiment of a support base and stand mounting member in accordance with the present invention; and, FIG. 19 illustrates a partial cross-sectional side elevation view of the support base and stand mounting member taken along line 19—19 of FIG. 18.

FIG. 18 illustrates another and/or alternate embodiment of a support platform 500 having a base member 520 and one or more retainers. An elongated slot 540 is disposed along base member 520 for acting as a handle or securing a separate handle (not shown) thereto. It will be appreciated that support base 500 and base member 520 can be used with any of the retainers discussed above with regard to FIGS. 3–7, either individually or in combination with one another. Base member 520 has a front edge 522, a rear edge 524 and two generally opposing side edges 526 and 528. Front edge 522 and rear edge 524 are generally curvilinear, and side edges 526 and 528 are disposed at an angle to one another, such that base member 520 is somewhat "pie shaped." Passages 534 and 536 are disposed along base member 520 adjacent front edge 522. As discussed above with regard to FIGS. 3–7, retainers, such as fasteners 150 (not shown in FIG. 18), and post assemblies 160 and 170 (not shown in FIG. 18), may be used with passages 534 and 536 of base member 520. Furthermore, numerous first portions 182 of hook and loop fasteners 180, as shown in FIG. 7, are provided on base member 520. Each of these retainers is capable of retaining an instrument component, such as a pedal assembly, on the base member of the support base. As discussed above, the shape of the base member can take any number of different forms. As can further be appreciated, one or more portions of the bottom of the base member can include hook-and-loop fasteners to facilitate in securing the base member to a floor. The base member can, either alternately or in combination, include standoffs, legs, feet, pads, bumpers or any other suitable floor-engaging members extending from the bottom of the base member.

Figure 19:
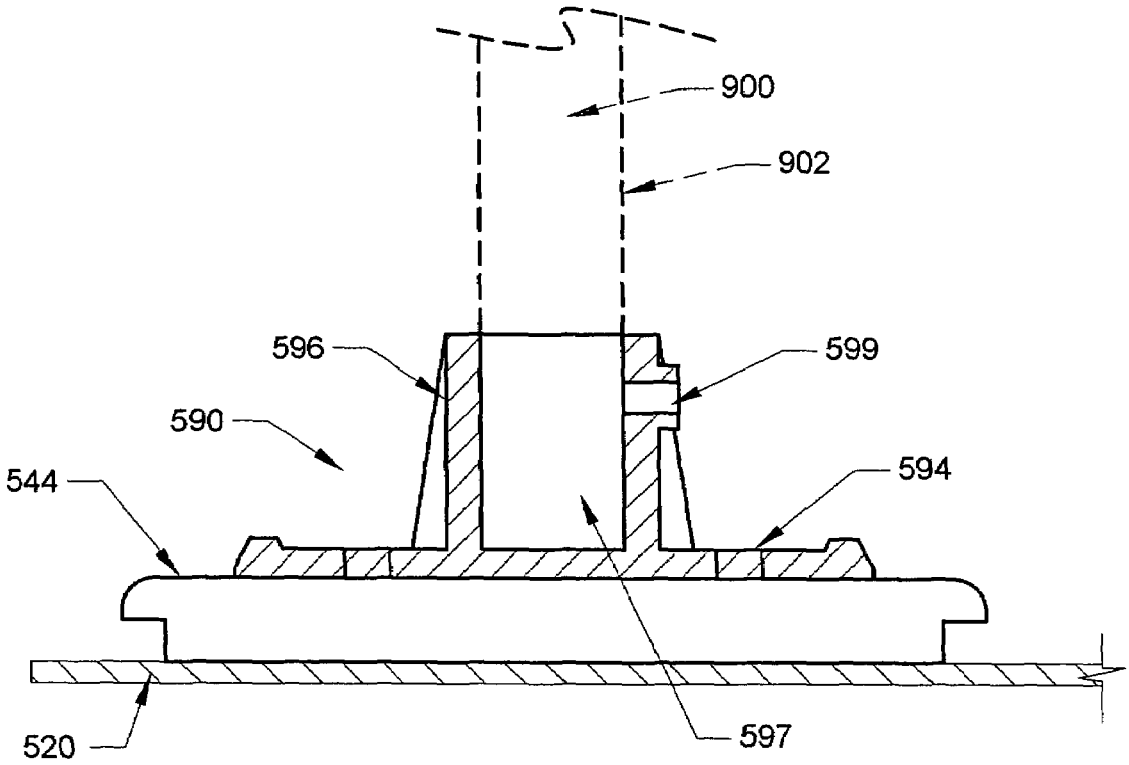

As illustrated in FIGS. 18 and 19, a stand mounting member 544 is supported on base member 520. The stand mounting member can be secured to the base member in any suitable manner, including as describe above with reference to stand mounting member 344 shown in FIGS. 9 and 10, and includes numerous passages 546. Furthermore, it should be appreciated that in this and other configurations, the provision of multiple instrument stands are contemplated. A stand base 590 is supported on stand mounting member 544, and is substantially identical to stand base 390 discussed above in reference to FIGS. 9–11 and 13. The stand base is suitable for receiving an instrument stand, such as instrument stand 900 also discussed in detail above. Stand base 590 includes a bottom flange 594 and a support column 596 extending from the bottom flange. A bore 597 extends into column 596 and is suitable for supporting tubular member 902 of instrument stand 900. A threaded handle (not shown) engages a complimentary hole 599 extending generally transversely relative to bore 597, and is suitable for projecting into the bore through the hole to engage and thereby secure the tubular member received therein. Passages 592 extend through flange 594 and have a pattern complimentary to passages 546 in stand mounting member 544 so that the stand base can be secured thereto using suitable fasteners (not shown).

The base members illustrated herein and discussed above include one or more passages, such as holes or slots, for example. It should be appreciated that such passages can be provided interchangeably, and are not intended to be limited to those configurations shown in the drawing figures. Rather, the drawings merely represent examples of passage configurations. What's more, the retainers, such as fasteners, post assemblies and hook and loop arrangements, can likewise be used interchangeably, and can be used individually, in multiples or in multiple combinations with one another without departing from the principles of the invention. For example, one or more instrument components, such as pedals, can be secured to the base member by a hook and loop fastener with a post abutting each of the one or more components to prevent any forward migration of the components that might occur over the restraint of the associated hook and loop fasteners. Additionally, the retainers shown and discussed herein are merely examples of suitable retainers, and any other suitable retainer or retaining apparatus may be used without departing from the principles of the invention. For example, other suitable retainers can include, but are not limited to, rivets, adhesives, magnets, and clamps.

The invention has been described with reference to the preferred embodiments. Obviously, modifications and alterations will occur to others upon reading and understanding the preceding detailed description. For example, the base member of the support base can include two or more pieces that are assembled together to form the base member, or the base member can be hinged or otherwise foldable to reduce the storage space associated therewith. As another example, the support base can include indicators, such as visual or tactile indicators on the base member, for example, to correspond to certain components and component placements on the base member. As an additional example, the base can include grounding provisions to reduce or discharge static electricity build-up an/or one or more connections for electronic components. It is intended that the invention be construed as including all such modifications and alterations insofar as they come within the scope of the appended claims or the equivalents thereof.

I claim:

1. A support base for supporting a plurality of instrument components comprising a base member and a retainer positioned on said base member, said retainer designed to at least partially retain at least one of said instrument components thereon, said retainer including a component fastener and a post, said post extending upwardly from said base member to a first instrument component and at least partially engaging said base member and said first instrument component, said component fastener designed to at least partially secure a second instrument component to said base member.

2. The support base of claim 1, wherein said base member includes metal.

3. The support base of claim 1, wherein said component fastener includes a plurality of passages extending at least partially through said base member.

4. The support base of claim 3, wherein said plurality of passages includes at least one elongated slot.

5. The support base of claim 3, wherein at least one of said plurality of passages extends through said base member.

6. The support base of claim 3, wherein said component fastener includes a hook-and-loop arrangement, said arrangement including a piece of hook material and a piece of loop material with one of said pieces of material secured to said base member and the other of said pieces of material at least partially secured to at least one of said instrument components.

7. The support base of claim 1, wherein said component fastener includes a hook-and-loop arrangement, said arrangement including a piece of hook material and a piece of loop material with one of said pieces of material secured to said base member and the other of said pieces of material at least partially secured to at least one of said instrument components.

8. A support base for at least partially retaining at least one percussion instrument component in a selected position, said support base comprising a base member, said base including a floor-engaging member extending from a bottom of said base member to inhibit movement of said base member on a floor surface, said base member including a plurality of component fasteners designed to orient and releasably secure a portion of a pedal assembly of percussion instruments to a top surface of said base member, said component fastener includes a plurality of passages extending at least partially through said base member, said plurality of passages include at least one elongated slot.

9. The support base of claim 8, wherein said base member is at least partially formed of metal, wood, plastic, composite material or combinations thereof.

10. The support base of claim 8, wherein at least one of said plurality of passages extends through said base member.

11. The support base of claim 8, wherein said component fastener includes a hook-and-loop arrangement, said arrangement including a piece of hook material and a piece of loop material with one of said pieces of material secured to said base member and the other of said pieces of material at least partially secured to at least one of said instrument components.

12. The support base of claim 8, further comprising a stand mounting member releasably secured on a top surface of said base member.

13. The support base of claim 8, further comprising a stand base at least partially supported on a stand mounting member and a stand shaft at least partially supported by said stand base.

14. A support base for orienting and releasably securing a plurality of percussion pedals comprising a base member having a front edge, a back edge, side edges, a top surface and a bottom surface, said top surface including a plurality of component fasteners to releasably secure and orient each percussion pedal in a plurality of positions on said top surface of said base member, said top surface includes a plurality of zones wherein each zone is designed to releasably secure a single percussion pedal in a plurality of orientations in said zone relative to at least one of said edges of said base member, each of said zones includes a plurality of component fasteners.

15. The support base as defined in claim 14, wherein said top surface of said base member includes at least one horizontal row of component fasteners positioned between the side edges of said base member, at least one other component fastener positioned between said top edge of said base member and said horizontal row of component fasteners.

16. The support base of claim 14, wherein at least one of a plurality of passages extends through said base member.

17. The support base of claim 14, wherein said component fastener includes a hook-and-loop arrangement, said arrangement including a piece of hook material and a piece of loop material with one of said pieces of material secured to said base member and the other of said pieces of material at least partially secured to at least one of said instrument components.

18. The support base as defined in claim 14, wherein said base member includes a floor-engaging member extending from a bottom of said base member to inhibit movement of said base member on a floor surface.

19. A support base for orienting and releasably securing a plurality of percussion pedals comprising a base member having a front edge, a back edge, side edges, a top surface and a bottom surface, said top surface including a plurality of component fasteners to releasably secure and orient each percussion pedal in a plurality of positions on said top surface of said base member, said top surface of said base member includes at least one horizontal row of component fasteners positioned between the side edges of said base member, at least one other component fastener positioned between said top edge of said base member and said horizontal row of component fasteners.

20. The support base as defined in claim 19, wherein said top surface of said base member includes at least two horizontal rows of component fasteners positioned between the side edges of said base member and including at least four vertical rows of component fasteners positioned between said top edge of said base member and said horizontal rows of component fasteners.

21. A support base for orienting and releasably securing a plurality of percussion pedals comprising a base member having a front edge, a back edge, side edges, a top surface and a bottom surface, said top surface including a plurality of component fasteners to releasably secure and orient each percussion pedal in a plurality of positions on said top surface of said base member, said component fasteners include at least one component fastener in the form of a slot and at least another component fastener positioned above said slot, said other component fastener selected from the group consisting of an opening or a hook and loop fastener.

22. The support base as defined in claim 21, wherein said component fasteners include at least two slots extending between said side edges of said base member and at least another component fastener positioned above said slots, said other component fastener selected from the group consisting of an opening or a hook and loop fastener.

23. A support base for orienting and releasably securing a plurality of percussion pedals comprising a base member, said base member including a plurality of base sections, each of said base sections including a front edge, a back edge, a top surface and a bottom surface, said top surface of a plurality of base sections including at least one component fastener, said component fasteners enabling a plurality of percussion components to be releasably secure to said base member.

24. The support base as defined in claim 23, said component fasteners include a plurality of openings, at least one hook and loop fastener, adhesive, at least one magnet, at least one clamp or combinations thereof.

25. The support base as defined in claim 23, wherein said at least one percussion component includes a percussion pedal, a drum, a cymbal or combinations thereof.

26. The support base as defined in claim 23, wherein said bottom surface includes a floor-engaging member that inhibits movement of said base member on a floor surface.

27. The support base as defined in claim 23, wherein a plurality of said base sections are connectable to one another.

28. The support base as defined in claim 23, wherein said top surface includes at least one position indicator for said at least one percussion component.

* * * * *